US009266592B2

(12) United States Patent
Peelman et al.

(10) Patent No.: US 9,266,592 B2
(45) Date of Patent: Feb. 23, 2016

(54) PROTECTOR FOR PROPELLER

(71) Applicants: Nicholas Peelman, Fontana, CA (US); Brent Todd, Fontana, CA (US)

(72) Inventors: Nicholas Peelman, Fontana, CA (US); Brent Todd, Fontana, CA (US)

( * ) Notice: Subject to any disclaimer, the term of this patent is extended or adjusted under 35 U.S.C. 154(b) by 278 days.

(21) Appl. No.: 13/892,572

(22) Filed: May 13, 2013

(65) Prior Publication Data

US 2014/0335749 A1 Nov. 13, 2014

(51) Int. Cl.
*B63H 5/16* (2006.01)

(52) U.S. Cl.
CPC ..... *B63H 5/165* (2013.01)

(58) Field of Classification Search
CPC ..... B63H 5/16; B63H 5/165; B65D 5/5002; B65D 5/5007; B65D 5/5009; B65D 81/02; B65D 81/022; B65D 2581/02; B65D 2581/05
USPC ..... 114/361; 440/66–73; D12/214; 150/154, 157; 416/247 R, 247 A
See application file for complete search history.

(56) References Cited

U.S. PATENT DOCUMENTS

| | | | | |
|---|---|---|---|---|
| 1,523,979 | A * | 1/1925 | Ryan et al. | 601/137 |
| 2,280,624 | A * | 4/1942 | Buckley | 601/136 |
| 2,566,650 | A * | 9/1951 | Anderson | 211/65 |
| 3,174,155 | A * | 3/1965 | Pitman | 2/411 |
| 4,699,597 | A * | 10/1987 | Oja | 440/66 |
| 4,972,527 | A * | 11/1990 | Wallace | 2/414 |
| 5,163,739 | A | 11/1992 | Stanlake | |
| 5,787,507 | A * | 8/1998 | Sullivan | 2/182.1 |
| D419,518 | S * | 1/2000 | Harrison | D12/214 |
| 6,491,267 | B1 | 12/2002 | Feldman | |
| 6,502,711 | B1 * | 1/2003 | Mc Rae | 220/23.4 |
| 6,986,689 | B2 * | 1/2006 | Norman | 440/67 |
| 2005/0066874 | A1 | 3/2005 | Tonokaboni et al. | |
| 2013/0032259 | A1 | 2/2013 | Ploch | |

OTHER PUBLICATIONS vat19.com (2013). Kapoosh: Universal knife block and utensil holder. Retrieved from http://www.vat19.com/dvds/kapoosh-universal-knifeblock-utensil-holder.cfm.

* cited by examiner

*Primary Examiner* — Ajay Vasudeva
(74) *Attorney, Agent, or Firm* — Loza & Loza, LLP; Derek Yeung

(57) ABSTRACT

Aspects of the present invention are directed to a propeller protector that can accommodate propeller of different sizes and is designed to be easily installed or removed from a propeller. The propeller protector includes a novel retaining device for securing the protector onto the blades of the propeller without using straps or similar devices. The novel retaining device has a high level of adaptability to accommodate blades of different sizes and shapes.

20 Claims, 12 Drawing Sheets

PROTECTOR FOR PROPELLER

BACKGROUND

Aspects of the present invention relate to propeller protectors, and more particularly, a propeller protector of inboard or outboard marine motor to improve safety to persons or animals in close proximity of a propeller. The blades of the propeller generally have sharp edges that can be hazardous to people or animals that come into contact with the blades. Severe injury is likely when accident occurs with an unprotected propeller.

Marine vessel or watercrafts operators often maneuver or anchor in relatively shallow water in various boating activities such as swimming, fishing, diving, snorkeling, etc. In these activities, the passengers often participate in activities in close proximity of the propeller. While the propeller may be stopped during these activities, its sharp unprotected blades can severely injury any person who may accidentally come into contact with the blades. Furthermore, underwater visibility may not be ideal, thus hindering the ability of the people above or in the water to see the propeller. It is also possible that strong current may be present in the water, and the people in the water may be pushed toward the propeller unknowingly.

Various safety devices have been used to protect a propeller in or out of the water. For example, the propeller may be encased in a cage that allows the propeller to be operated with the cage attached. However, such protective cage may create undesirable drag in the water and reduce the efficiency of the motor. The cage may also decrease the maneuverability of the boat in shallow water.

Various protective covers have been used to cover the propeller. Some covers include individual covers for each blade of the propeller. However, the individual covers may easily be lost or misplaced. Some covers include a box shape enclosure that is sized to cover all the blades. However, known examples of these type of covers generally use some forms of attachment devices or straps to secure or attach the cover to the propeller shaft, or to have an opening that is sized to be smaller than the propeller's size. While some protectors may be adjustable to accommodate different propeller sizes, the adjustment operation is often cumbersome and time consuming in order to install or remove the propeller cover. Therefore, there is still a need for a propeller protector that can be used on propeller of different sizes and can be easily installed and removed while the propeller is submerged, for example, when a boat remains stationary with its engine off in the water or being loaded into the water from a trailer.

BRIEF SUMMARY

Aspects of the present invention are directed to a propeller protector that can accommodate propeller of different sizes and is designed to be easily installed or removed from a propeller. The propeller protector includes a novel retaining device for securing the protector onto the blades of the propeller without using straps or similar devices. The novel retaining device has a high level of adaptability to accommodate blades of different sizes and shapes.

In an embodiment, a protector for protecting a propeller includes a housing having an exterior surface, an interior surface, and an opening facing a first direction for receiving the propeller. A plurality of bendable fingers extend inwardly from the interior surface toward a center portion of the housing, and the fingers are configured to engage one or more blades of the propeller when at least a portion of the propeller is received into the housing through the opening.

In various aspects of the embodiment, the protector may further include a buoyant casing covering at least a portion of the exterior surface of the housing. The buoyant casing may include a flexible material. The buoyant casing may include a plastic material. The buoyant casing may have a bright color.

In various aspects of the embodiment, the plurality of fingers may include at least two layers of bendable fingers, and the layers are spaced apart in the first direction. The at least two layers of bendable fingers may include a first layer and a second layer, and the bendable fingers of the first layer are offset from the bendable fingers of the second layer in a direction different from the first direction. The first layer and the second layer may have different numbers of fingers per layer, or the same number of fingers per layer. The plurality of fingers may be arranged in a radial pattern.

In various aspects of the embodiment, the housing may have a notch on the exterior surface. The protector may further include one or more handles attached to the exterior surface, respectively. One of the handles may be positioned on a side of the housing opposite the opening.

In various aspects of the embodiment, the protector may be configured to be secured on the propeller by utilizing only two or more of the fingers to grip on at least one of the blades.

In various aspects of the embodiment, a shape of the protector opening may be circular, elliptical, rectangular, polygonal, or irregular. The opening may have a width larger than an outside end-to-end dimension of the propeller so as to receive the propeller therein.

In various aspects of the embodiment, the housing (e.g., an inner shell) and the casing (e.g., an outer shell) each have one or more venting holes configured to allow fluid communication between an interior space and an exterior space of the propeller protector.

In various aspects of the embodiment, some of the plurality of fingers may cross each other in a direction different from the first direction (e.g., axial direction). A spacing among the plurality of fingers may be uniform or non-uniform. A space between two adjacent fingers of the plurality of fingers is smaller than a space occupied by a blade of the propeller.

BRIEF DESCRIPTION OF THE DRAWINGS

Exemplary embodiments of the present invention will be presented in the following detailed description, taken in connection with the accompanying drawings, in which.

DETAILED DESCRIPTION OF THE EMBODIMENTS

Various aspects of the present invention relate to a propeller protector (e.g., protector for marine or watercraft propeller) that is designed to be utilized when the propeller is not running. Some applications of the propeller protector include keeping swimmers, people, and animals near the non-running propeller, while the propeller is in or out of the water, protected from kicking, striking, hitting, running into, or coming into contact with the propeller in various ways. The propeller protector can also be used for out of water personal protection in the same way while the watercraft or boat is on its trailer.

By way of example, and not limiting, the propeller protector may have an opening that is substantially round in shape and has a circumference that is slightly larger than an average size of a marine propeller. However, the present invention is not limited to any particular size and shape, and the propeller protector may have other suitable shapes and sizes. In some embodiments, the propeller protector may have a suitable buoyance such that the protector will stay afloat if the protector is dislodged from the propeller by accident. In an embodiment, the propeller protector may have an outer shell or casing that may be constructed of a soft buoyant bright colored (e.g., red, yellow, etc.) material (e.g., a foam or spongy material) that encompasses an inner shell partially or completely.

In some embodiments, the inner shell may be constructed of a plastic material or other suitable materials that may have any suitable shapes. A plurality of bendable fingers or resilient elongated members extend from an interior surface of the inner shell. The bendable fingers are configured to keeping the protector secured to the propeller while the propeller is under or out of the water while the propeller is in a non-running state. In some embodiments, one or more handles may extend from respective sides (e.g., back side) of the protector to facilitate handling of the protector. For example, a user may place the protector on or off of the propeller with ease using the handle. In an embodiment, a strap (e.g., a snapping strap) may be used to secure the protector to the propeller for out of water trailered travel of the boat. Hereafter, aspects of the present invention are illustrated in more detail in reference to exemplary embodiments. However, the present invention is not limited as such. Changes and modifications to the illustrated embodiments are within the scope of the present invention as defined in the appended claims.

Figure 1:
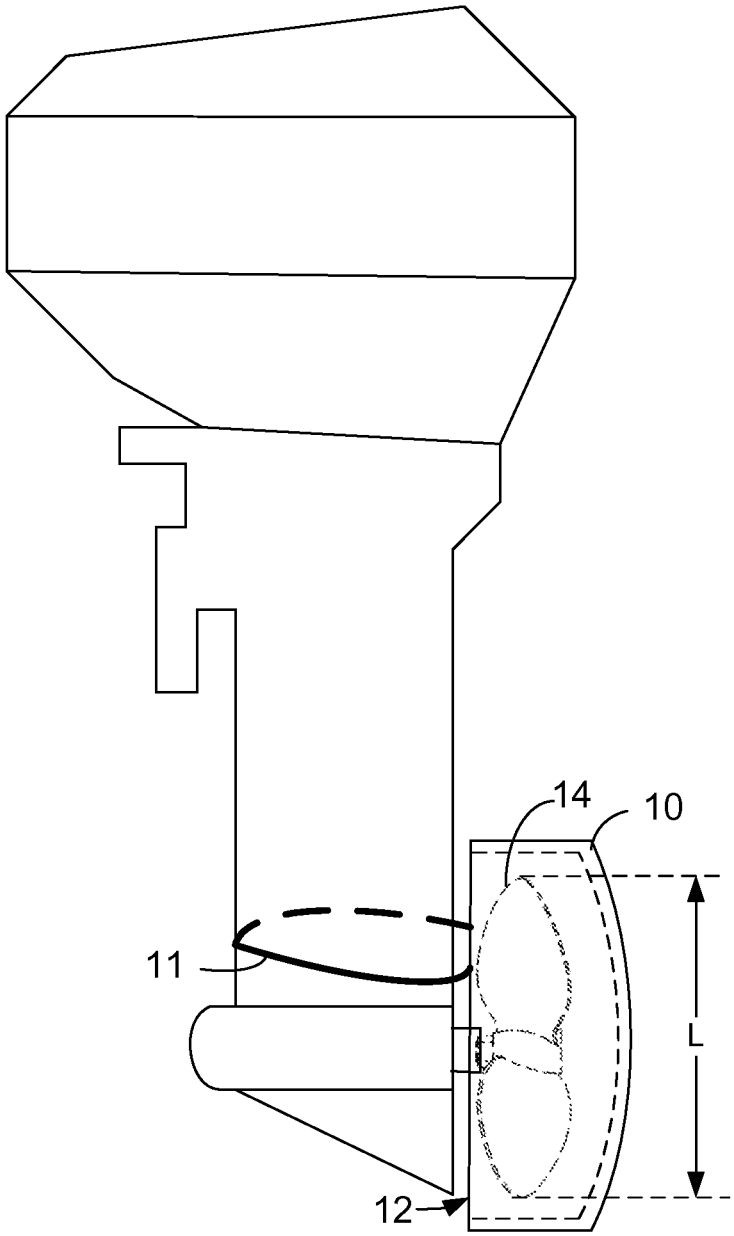
FIG. 1 is a conceptual drawing illustrating a side view of a propeller protector attached to an outboard motor in accordance with an embodiment of the present invention.

FIG. 1 is a conceptual drawing illustrating a side view of a propeller protector 10 attached to an outboard motor in accordance with an embodiment of the present invention. The propeller protector 10 has an opening 12 sized (width) to be suitably larger than an outside end-to-end dimension (L) of a propeller 14. The opening 12 may have any suitable shapes such as circular, rectangular, polygonal shapes, irregular, etc. The propeller protector 10 can be secured on the propeller 14 with or without using other attachment devices that attach to other parts of the outboard motor. In an embodiment, the propeller protector 10 includes a plurality of elongated members (to be described in more detailed below) extending from an interior surface of the protector for securing the protector 10 on the propeller 14.

Figure 2:
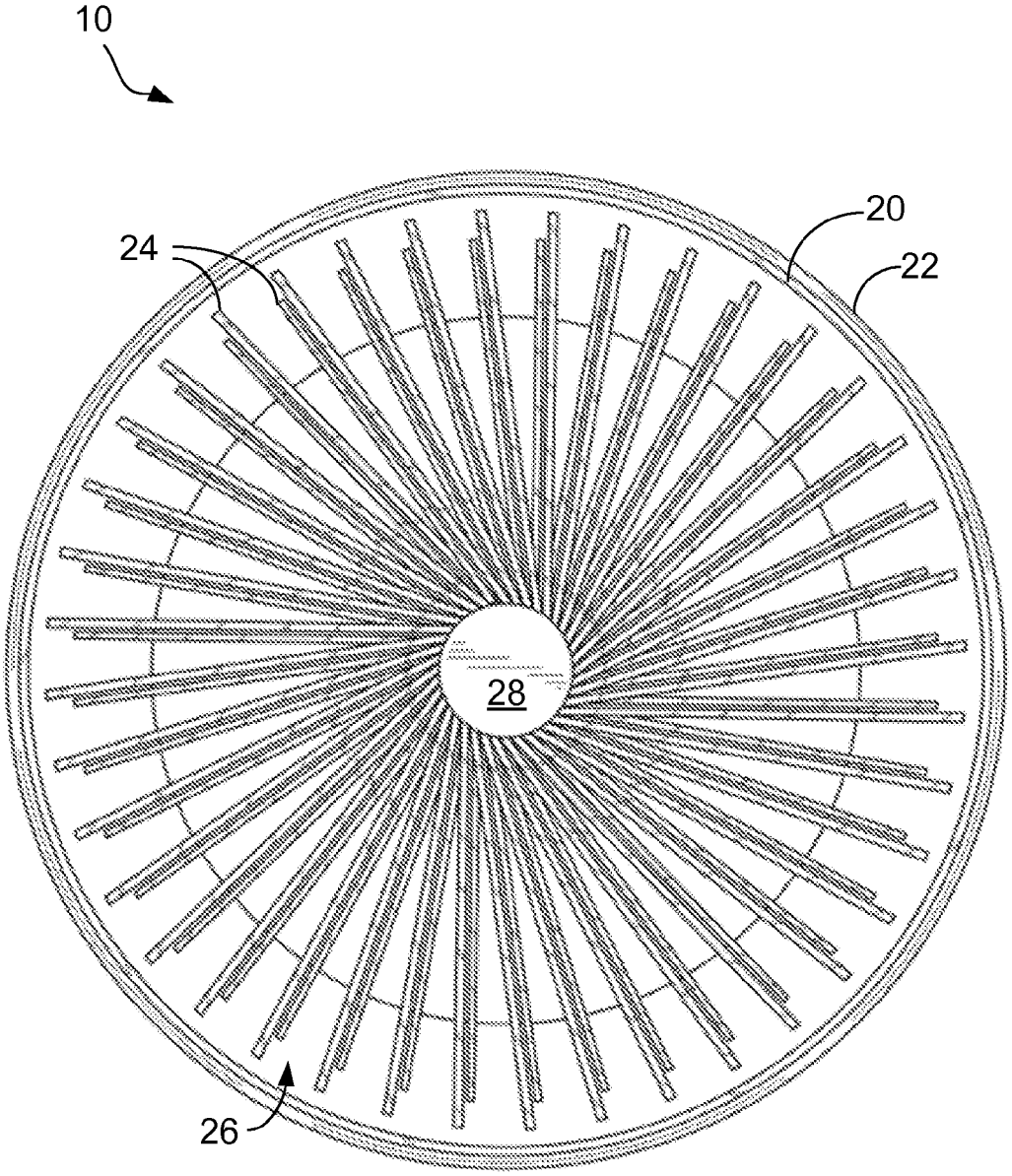
FIG. 2 is a conceptual drawing illustrating a front view of a propeller protector in accordance with an embodiment of the present invention.
Figure 3:
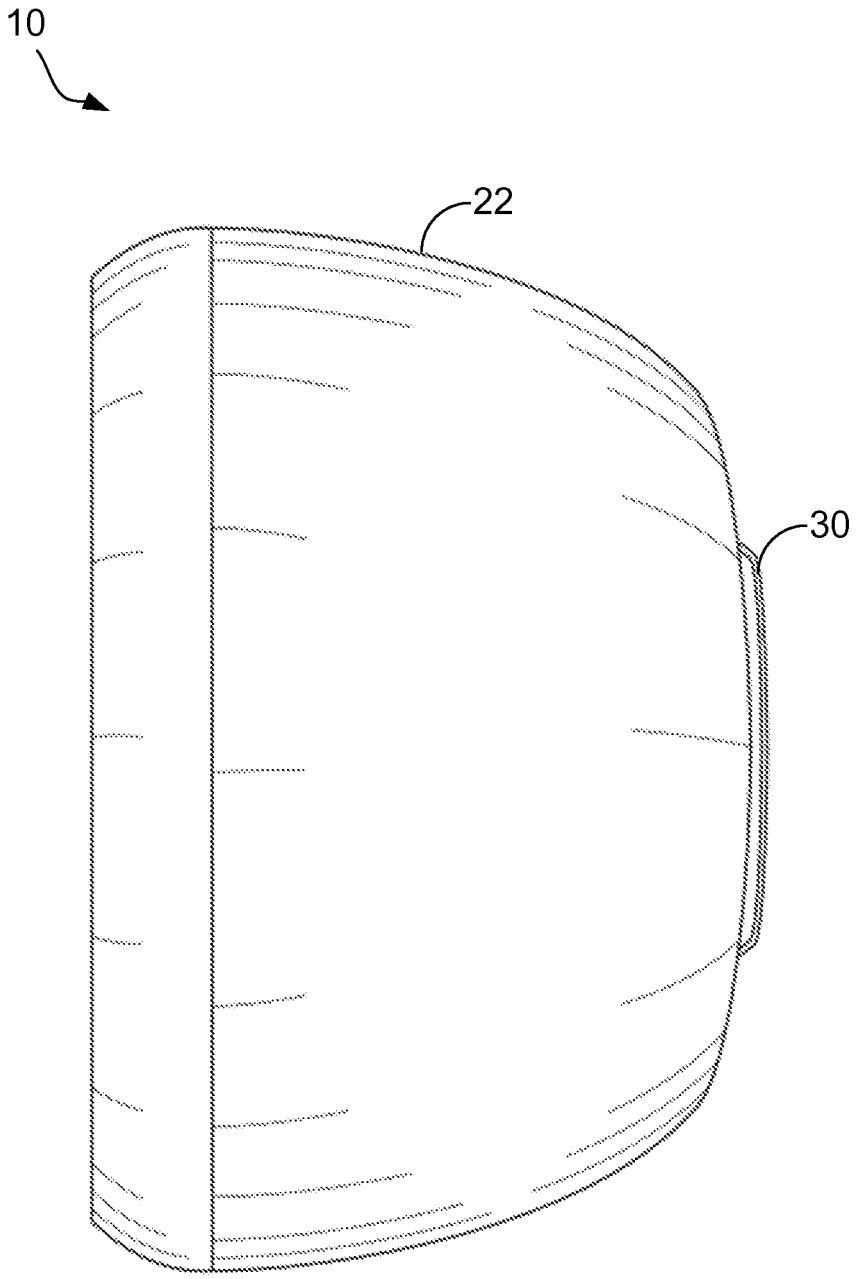
FIG. 3 is a conceptual drawing illustrating a side view of the propeller protector of FIG. 2.
Figure 4:
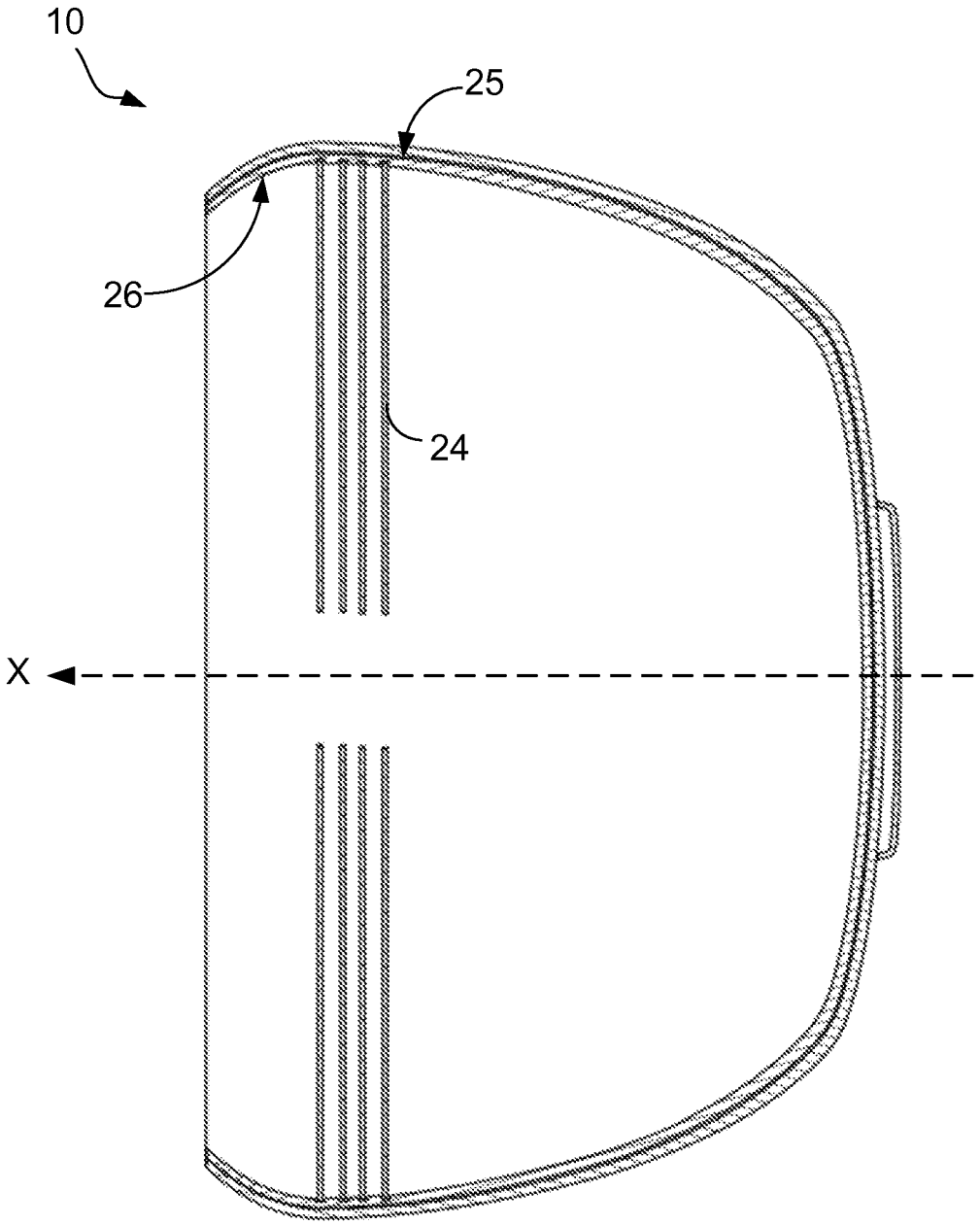
FIG. 4 is a conceptual drawing illustrating a cross sectional view of the propeller protector of FIG. 2.
Figure 5:
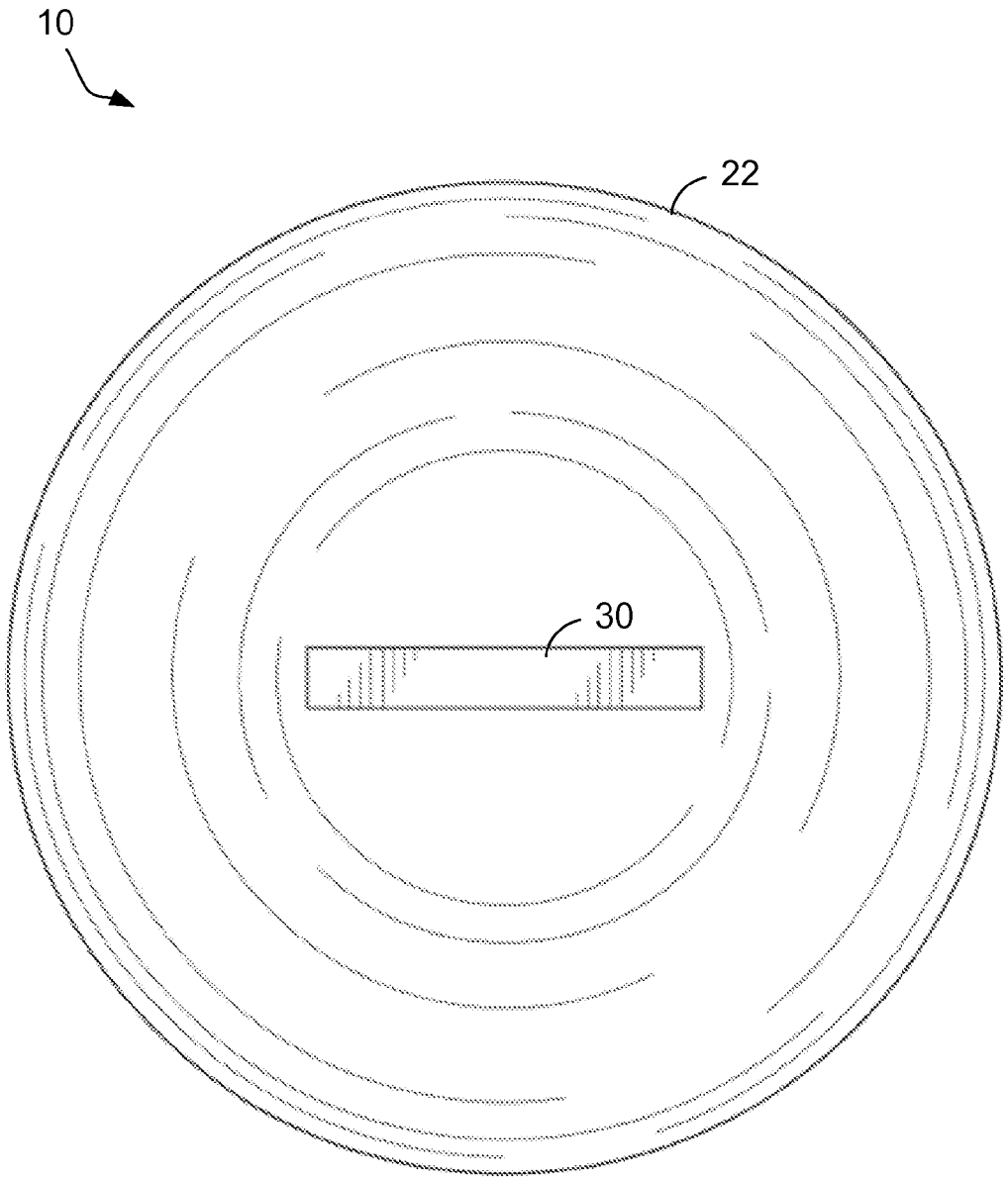
FIG. 5 is a conceptual drawing illustrating a back view of the propeller protector of FIG. 2 in accordance with an embodiment of the present invention.
Figure 6:
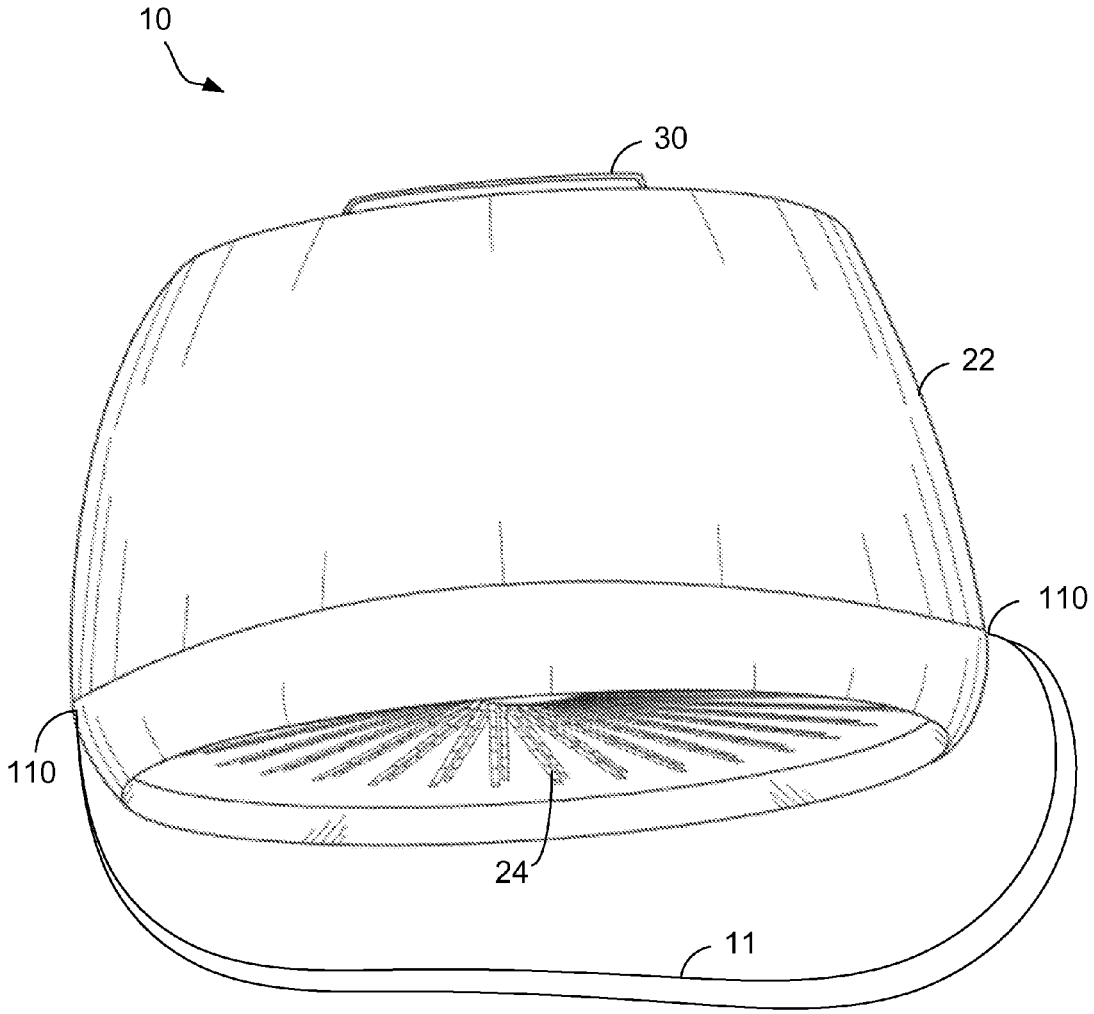
FIG. 6 is a conceptual drawing illustrating a perspective view of the propeller protector in accordance with an embodiment of the present invention.

FIG. 2 is a conceptual drawing illustrating a front view of a propeller protector 10 in accordance with an embodiment of the present invention. FIG. 3 is a conceptual drawing illustrating a side view of the propeller protector 10. FIG. 4 is a conceptual drawing illustrating a cross sectional view of the propeller protector 10. FIG. 5 is a conceptual drawing illustrating a back view of the propeller protector 10. FIG. 6 is a conceptual drawing illustrating a perspective view of the propeller protector 10.

In an embodiment, the propeller protector 10 has a round shape opening for receiving the propeller 14. The propeller protector 10 has a housing 20 (e.g., inner shell) and optionally a casing 22 (e.g., an outer shell, a cover, etc.) covering as least a portion of an exterior surface 25 (see FIG. 4) of the housing 20. The housing 20 may be made of plastic or other suitable materials (e.g., flexible material), and the casing 22 may be made of a buoyant material (e.g., foam) such that the propeller protector 10 may float in water. Therefore, it is easier to recover the protector 10 if it is removed or accidentally dislodged from the propeller. In some embodiments, the casing 22 may be brightly colored to improve its visibility. In some embodiments, the casing 22 may have a thickness of about 1 inch to 1.5 inches.

A number of bendable (or resilient) fingers 24 or beams extend inwardly from an interior surface 26 toward a center portion 28 of the housing 20. In an embodiment, the fingers 24 may be arranged in a radial pattern. The fingers 24 are suitably spaced apart from each other. In an embodiment, the fingers 24 may be arranged in two or more layers (e.g., see FIG. 4) of bendable fingers that are substantially parallel to each other and spaced apart in at least one direction (e.g., X direction in FIG. 4) that is substantially normal to the opening 12. In some embodiments, the number of fingers in each of the layers may be different or the same per layer. In some embodiments, the spacing among the fingers 24 may be non-uniform, uniform, or a combination thereof. In an embodiment, the fingers 24 may be arranged in groups, and the groups are separated from each other. The fingers 24 of different layers may be offset from each other in a direction that is different from the axial direction (e.g., X direction in FIG. 4) of the housing 20.

Figure 9:
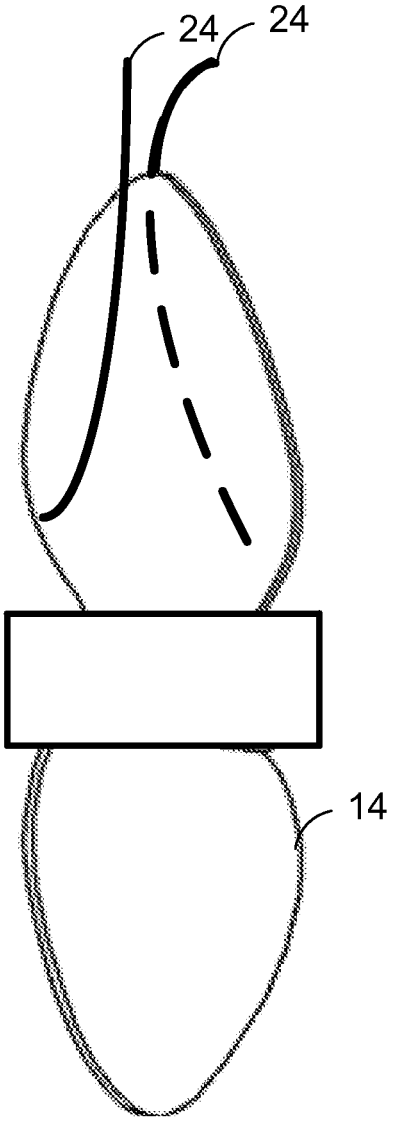
FIG. 9 is a conceptual drawing illustrating a propeller held by two fingers from opposite sides of the blade.

The fingers 24 have suitable flexibility or bendability so that the fingers 24 can engage at least one or more blades of the propeller 14 when at least a portion of the propeller 14 is received into the housing 20 through the opening 12. To install the propeller protector 10, it is orientated such that it's opening 12 faces toward and generally centers on the propeller 14. Then, the propeller protector 10 is pushed onto the propeller 14. Because the fingers 24 are bendable, they will be bent as the blades of the propeller 14 force their way through the fingers 24. The fingers 24 have suitable resilience such that they tend to return to their original shape. Therefore, the blades of the propeller 14 will be held in the space among the fingers 24 because the displaced fingers 24 will exert a force on the blades. The distance (e.g., in the axial direction) between adjacent fingers 24 is suitably designed to be smaller than the space occupied by a blade of the propeller 14. As such, some of the fingers 24 will remain in a bent position when at least a portion of the propeller (e.g., blades) are located inside the house 20 and surrounded by the bent fingers 24. The bent fingers 24, therefore, can exert a force on the propeller or blades from multiple directions (e.g., opposite directions) such that the propeller protector 10 can be sufficiently secured on the propeller 14 using the fingers 24 only. That is, the propeller protector 10 may be secured on the propeller 14 utilizing only two or more of the fingers to grip on at least one of the blades. FIG. 9 is a conceptual drawing illustrating a propeller 14 held by two fingers 24 from opposite sides of the blade. In FIG. 9, the fingers 24 extend from the interior surface 26 of the housing 20 (e.g., see FIG. 2) toward the center portion 28 of the housing.

In some embodiments, a strap 11 (see FIGS. 1 and 6) or other similar devices may be used to additionally secure the propeller protector 10 to the propeller 14. The strap 11 may have a suitable elasticity. The ends 110 of the strap 11 are attached to opposite sides of the propeller protector 10. One or both ends of the strap 11 may be removably attached to the protector 10. In some embodiments, the propeller protector 10 may not have the casing 22. In some embodiments, the housing 20 has a suitable buoyancy. In an embodiment, a handle 30 may be provided at the back of the propeller protector 10 such that a user may maneuver the protector 10 with the handle 30.

Figure 7:
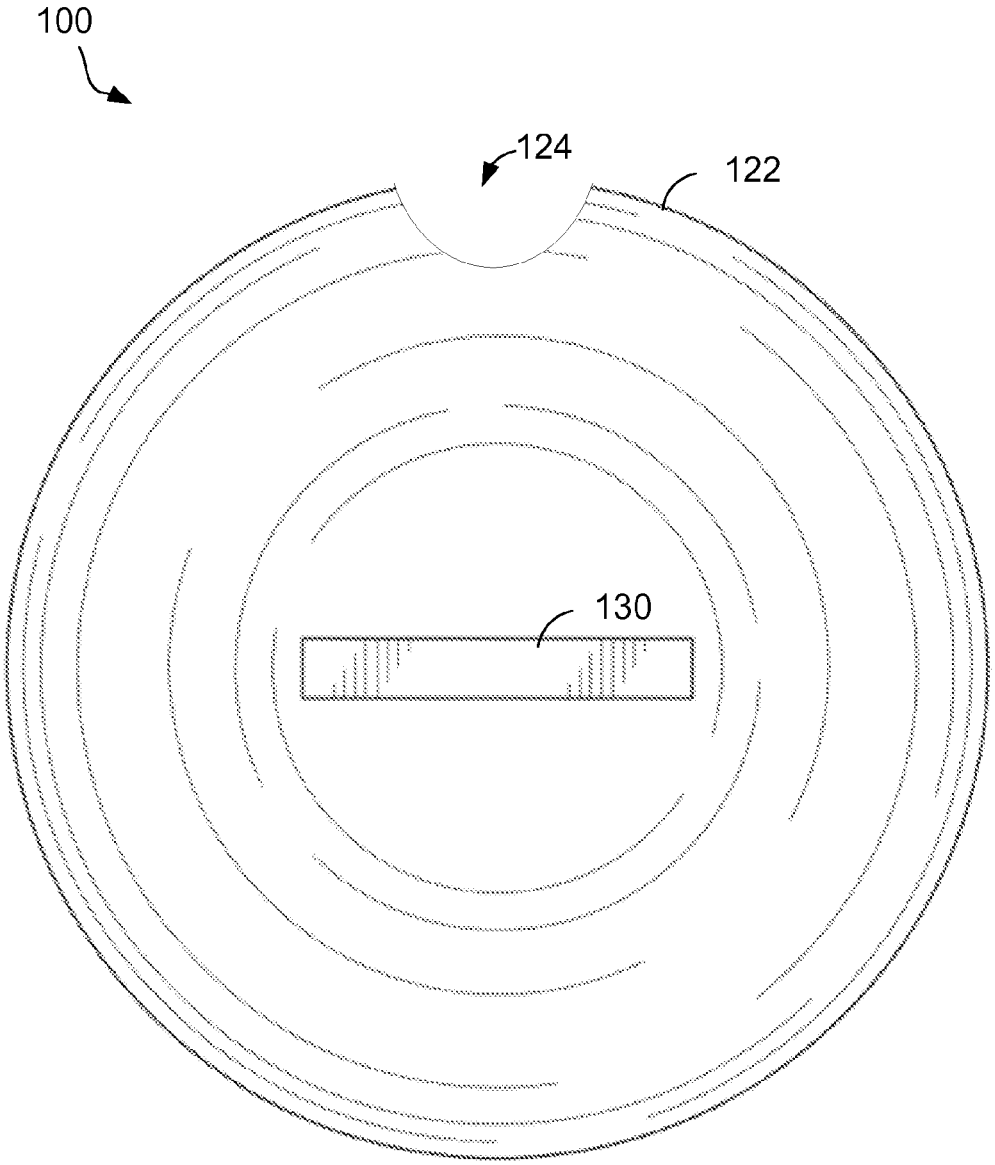
FIG. 7 is a conceptual drawing illustrating a back view of a propeller protector in accordance with another embodiment of the present invention.

FIG. 7 is a conceptual drawing illustrating a back view of a propeller protector 100 in accordance with another embodiment of the present invention. The propeller protector 100 is substantially similar to the propeller protector 10, therefore, only their differences will be described herein. The propeller protector 100 has a housing (not shown in FIG. 7) and a casing 122 covering the housing. A notch or slot 124 is formed in the housing and/or casing 122 such that when the propeller protector 100 is installed on a propeller, the slot 124 may provide clearance for objects (e.g., parts of an outboard motor, bottom portion of a boat, rudder, etc.) near the propeller. The notch 124 may have any suitable shapes and sizes. In one embodiment, the notch 124 may have a concave shape or any other suitable shapes.

Figure 8:
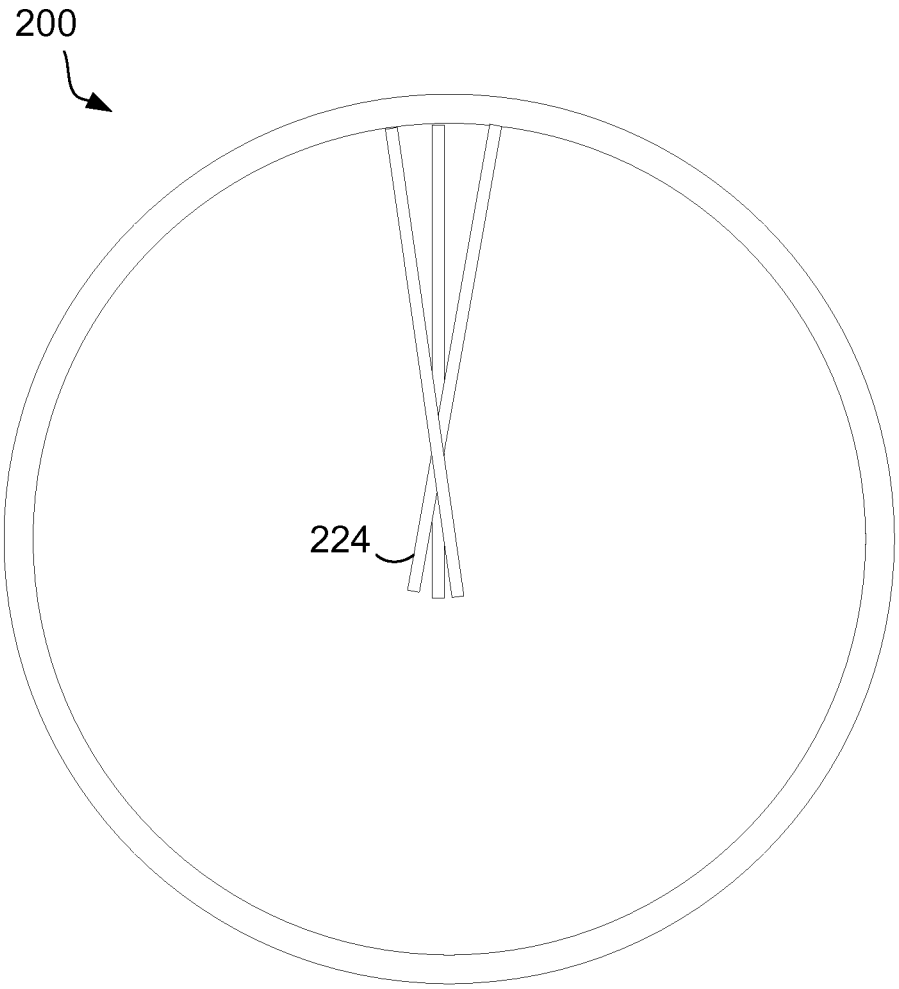
FIG. 8 is a conceptual drawing illustrating a front view of a propeller protector in accordance with another embodiment of the present invention.

FIG. 8 is a conceptual drawing illustrating a front view of a propeller protector 200 including a plurality of bendable fingers 224 in accordance with another embodiment of the present invention. The propeller protector 200 is substantially similar to the protector 10. Therefore, only their differences will be described for clarity. While only three bendable fingers 224 are shown in FIG. 8, the propeller protector 200 actually includes a plurality of bendable fingers 224 extending from all sides of the interior surface similar to those of the propeller protector 10. Some of the bendable fingers 224 cross each other in a direction substantially perpendicular to an axial direction of the propeller protector 200.

Figure 10:
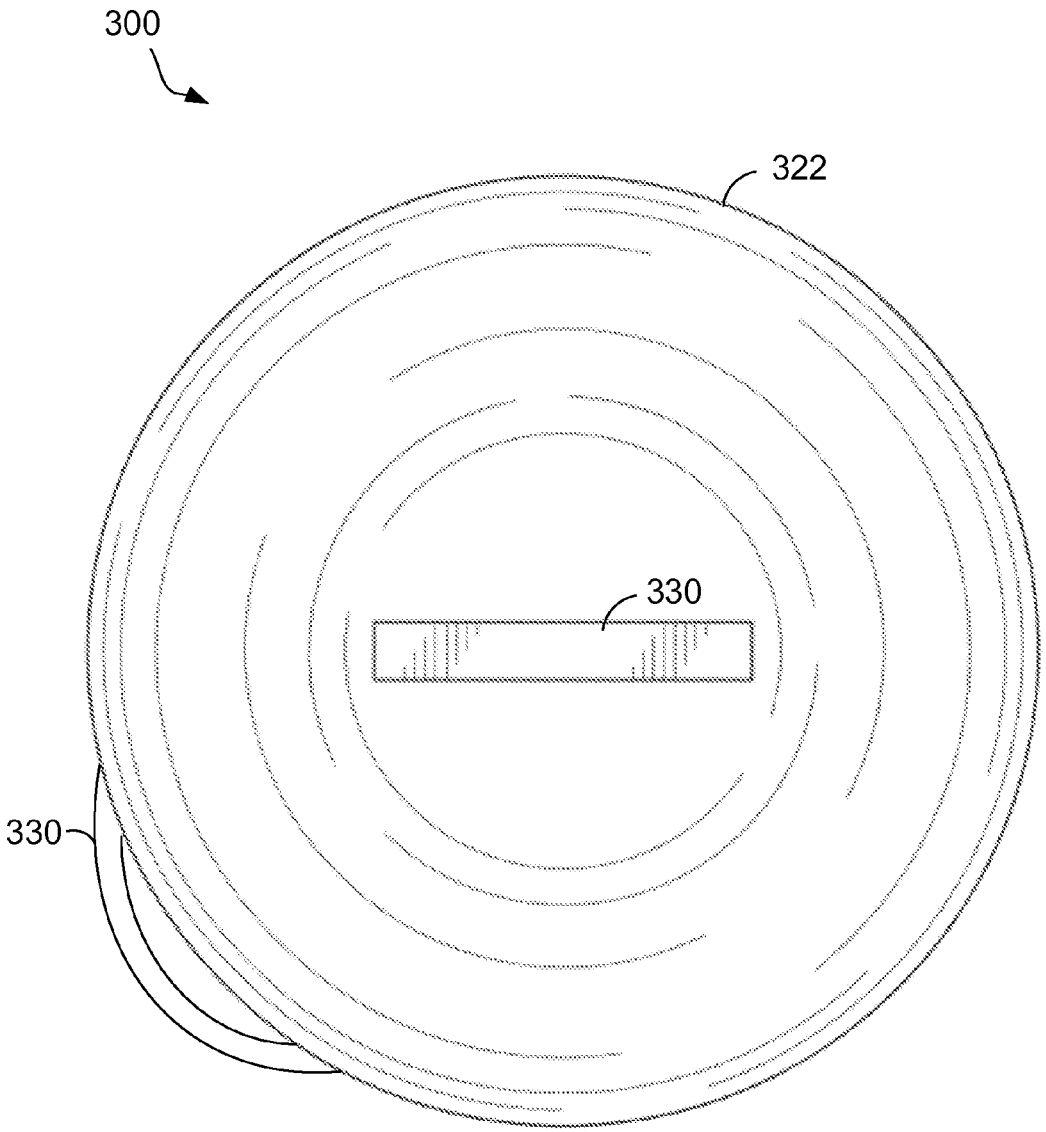
FIG. 10 is a conceptual drawing illustrating a back view of a propeller protector in accordance with another embodiment of the present invention.

FIG. 10 is a conceptual drawing illustrating a back view of a propeller protector 300 in accordance with another embodiment of the present invention. The propeller protector 300 is substantially similar to the propeller protectors 10, 100, and 200; therefore, only their differences will be described herein. The propeller protector 300 has a housing (not visible in FIG. 10, similar to the housing 20) and a casing 322 covering the housing. The propeller protector 300 may have one or more handles 330 on one or more sides of the casing 322.

Figure 11:
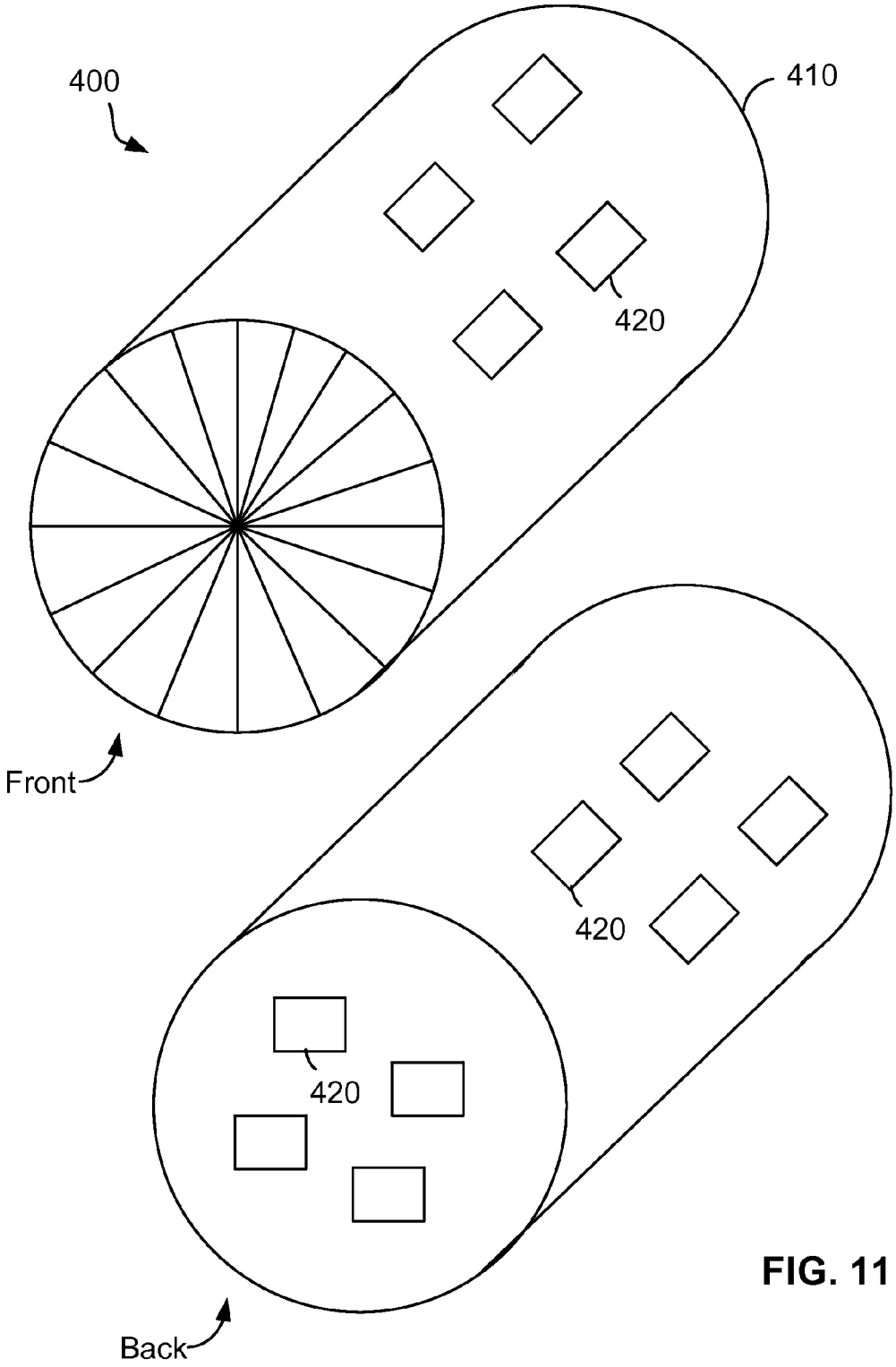
FIG. 11 is a conceptual drawing illustrating perspective front and back views of an inner shell for a propeller protector in accordance with another embodiment of the present invention.

FIG. 11 is a conceptual drawing illustrating perspective front and back view of an inner shell 400 for a propeller protector in accordance with another embodiment of the present invention. The inner shell 400 may be used as the inner shell (e.g., housing) of the propeller protectors 10, 100, 200, and 300. The shape and size of the inner shell 400 may be exaggerated in the drawing for ease of illustration. The inner shell 400 may have any suitable shapes and sizes in various applications. The inner shell 400 may have one or more venting holes 420 at one or more positions. In various embodiments, the venting holes 420 may have any suitable positions, shapes, and sizes. In one embodiment, the venting holes 420 may have substantially the same size and/or shape. In another embodiment, some of the venting holes 420 may have different sizes and/or shapes. The venting holes 420 allow fluid communication between an interior space and an exterior space of the inner shell 400.

Figure 12:
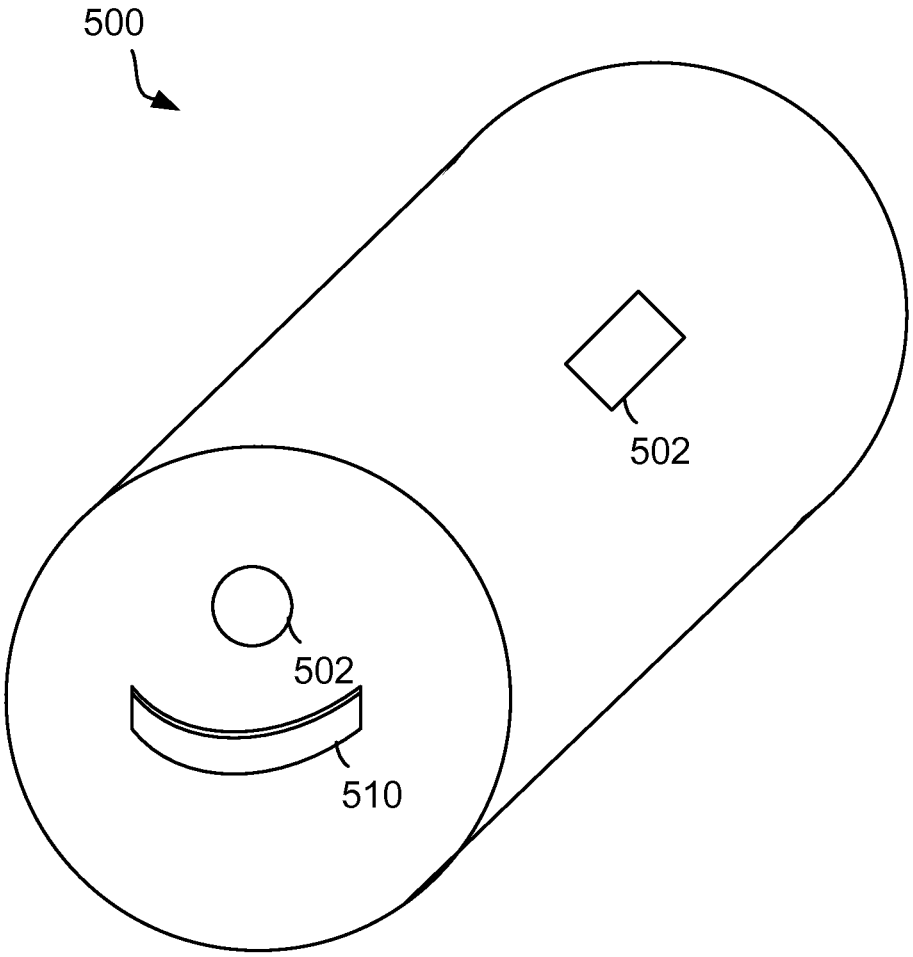
FIG. 12 is a conceptual drawing illustrating a perspective view of an outer shell for a propeller protector in accordance with another embodiment of the present invention.

FIG. 12 is a conceptual drawing illustrating a perspective view of an outer shell 500 for a propeller protector in accordance with another embodiment of the present invention. The outer shell 500 may be used as the outer shell (e.g., casing) of the propeller protectors 10, 100, 200, and 300. The shape and size of the outer shell 500 may be exaggerated in the drawing for ease of illustration. The outer shell 500 may have any suitable shapes and sizes in various applications. The outer shell 500 may have one or more venting holes 502 at one or more positions. By way of illustration and not limitation, two venting holes 502 are respectively located at the side and back of the outer shell 500. In various embodiments, the venting holes 502 may have any suitable positions, shapes, and sizes. In one embodiment, the venting holes 502 may have substantially the same size and/or shape. In another embodiment, some of the venting holes 502 may have different sizes and/or shapes. The venting holes 502 allow fluid communication between an interior space and an exterior space of the outer shell 500.

When the venting holes 420 and 502 are featured at the inner and outer shells of a propeller protector (e.g., the propeller protector 10, 100, 200, or 300), water or fluid can easily escape from the inside of the propeller protector to the outside thereof.

Although the foregoing has been described in terms of certain embodiments, other embodiments will be apparent to those of ordinary skill in the art from the disclosure herein. Figures are illustrative and not drawn to scale. The described embodiments have been presented by way of example only and are not intended to limit the scope of the disclosure. The various features of the described embodiments may be combined in different ways in different embodiments. Indeed, the novel apparatus and methods described herein may be embodied in a variety of other forms without departing from the spirit thereof. Thus, the invention is not limited by any preferred embodiments, but is defined by reference to the appended claims.

What is claimed is:

1. A protector for protecting a propeller, comprising:

a housing with a substantially symmetrical shape having an exterior surface, an interior surface, an opening facing a first direction for receiving the propeller, and a central axis extending longitudinally through the opening, wherein the housing comprises a buoyant material; and a plurality of bendable fingers of substantially same length extending inwardly from the interior surface toward a center portion of the housing, the fingers having fixed ends attached to the interior surface and free distal ends together defining the center portion of the housing, the fingers being configured to engage one or more blades of the propeller when at least a portion of the propeller is received into the housing through the opening, wherein the fingers extend toward an outer periphery of the center portion so that the free distal ends of the fingers are pointed away from the central axis, and wherein the length of each of the fingers is greater than the shortest distance between the inner surface and the center portion.

2. The protector of claim 1, wherein the housing comprises a flexible material.

3. The protector of claim 1, wherein the housing comprises a plastic material.

4. The protector of claim 1, wherein the housing has a bright color.

5. The protector of claim 1, wherein the plurality of fingers comprise at least two layers of bendable fingers, the layers being spaced apart in the first direction.

6. The protector of claim 5, wherein the at least two layers of bendable fingers comprise a first layer and a second layer, and the bendable fingers of the first layer are offset from the bendable fingers of the second layer in a direction different from the first direction.

7. The protector of claim 6, wherein the first layer and the second layer have different numbers of fingers per layer.

8. The protector of claim 6, wherein the first layer and the second layer have the same number of bendable fingers per layer.

9. The protector of claim 1, wherein the plurality of fingers are arranged in a radial pattern.

10. The protector of claim 1, wherein the housing has a notch on the exterior surface.

11. The protector of claim 1, further comprising a casing covering at least a portion of the exterior surface of the housing and one or more handles attached to the casing.

12. The protector of claim 11, wherein one of the handles is positioned on a side of the housing opposite the opening.

13. The protector of claim 1, wherein the protector is configured to be secured on the propeller by utilizing only two or more of the fingers to grip on at least one of the blades.

14. The protector of claim 1, wherein a shape of the opening is circular, elliptical, rectangular, polygonal, or irregular.

15. The protector of claim 1, wherein the opening has a width larger than an outside end-to-end dimension of the propeller so as to receive the propeller.

16. The protector of claim 1, wherein some of the plurality of fingers cross each other in a direction different from the first direction.

17. The protector of claim 1, wherein a spacing among the plurality of fingers is substantially uniform.

18. The protector of claim 1, wherein a spacing among the plurality of fingers is non-uniform.

19. The protector of claim 1, wherein a space between two adjacent fingers of the plurality of fingers is smaller than a space occupied by a blade of the propeller.

20. The protector of claim 1, wherein the housing has one or more venting holes configured to allow fluid communication between an interior space and an exterior space of the protector.

* * * * *